US005816079A

United States Patent [19]

Wang

[11] Patent Number: 5,816,079

[45] Date of Patent: Oct. 6, 1998

[54] NEEDLE POSITION DETECTING SYSTEM FOR A CIRCULAR KNITTING MACHINE

[75] Inventor: Ping-Shin Wang, Taipei, Taiwan

[73] Assignee: Pai Lung Machinery, Taipei, Taiwan

[21] Appl. No.: 837,108

[22] Filed: Apr. 14, 1997

[51] Int. Cl.[6] ..... D04B 35/18

[52] U.S. Cl. ..... 66/218; 250/559.29; 250/233; 250/237 G; 66/218

[58] Field of Search ..... 66/218, 232, 165, 66/157; 250/210, 233, 559.29, 237 G; 364/470.12

[56] References Cited

U.S. PATENT DOCUMENTS 3,670,527 6/1972 Bourgeois ..... 66/50 R
3,831,402 8/1974 Schuman ..... 66/50 R
3,955,383 5/1976 Hasegawa et al. ..... 66/218
5,524,460 6/1996 Michetti et al. ..... 66/165

*Primary Examiner*—Andy Falik
*Attorney, Agent, or Firm*—Bacon & Thomas

[57] ABSTRACT

A needle position detecting system for a circular knitting machine inputs the needle position to a computer which controls the needles to perform jacquard knitting. The knitting machine includes a needle cylinder carrying a plurality of needles, a driven gear fixedly mounted on the needle cylinder and driven to turn it by a motor driven gear. An optical encoder coaxially connected to the drive gear counts the number of rotations of the drive gear and the needle cylinder and sends a signal to the computer for calculating a respective needle position.

2 Claims, 5 Drawing Sheets

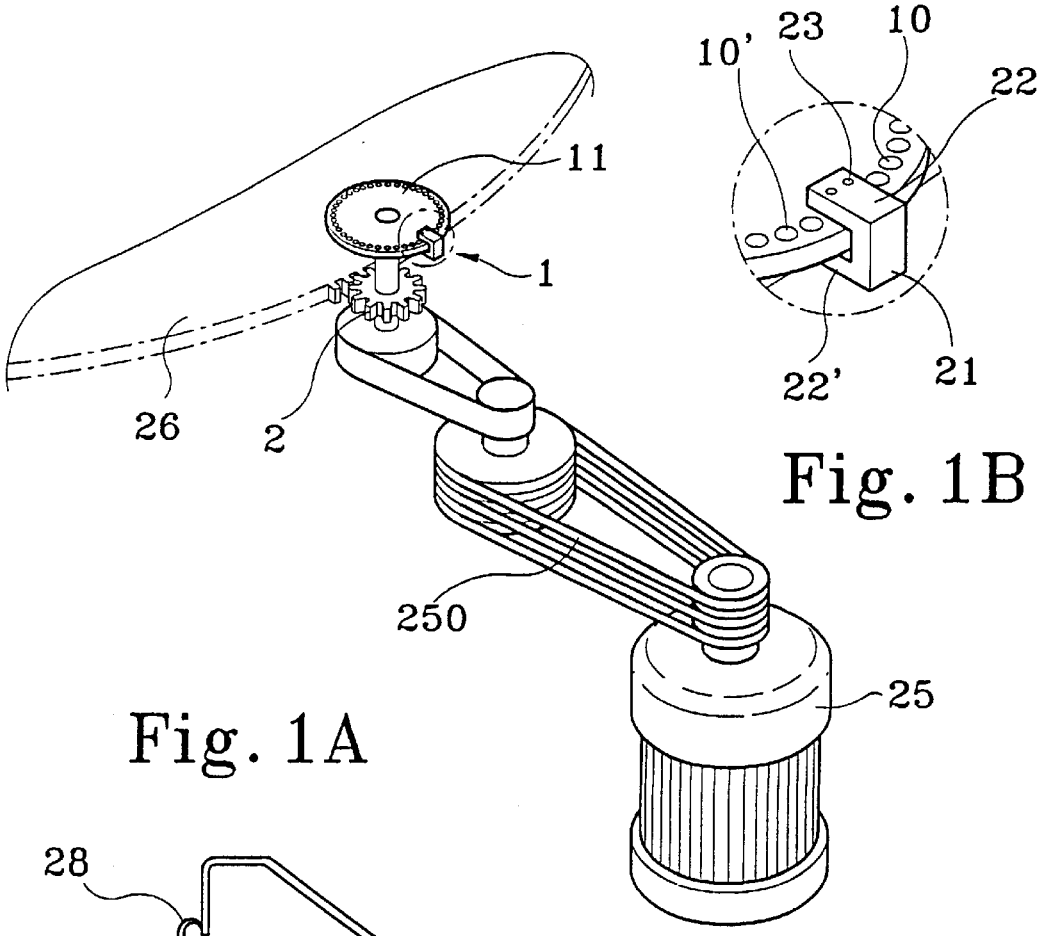
Fig. 1B
Fig. 1A
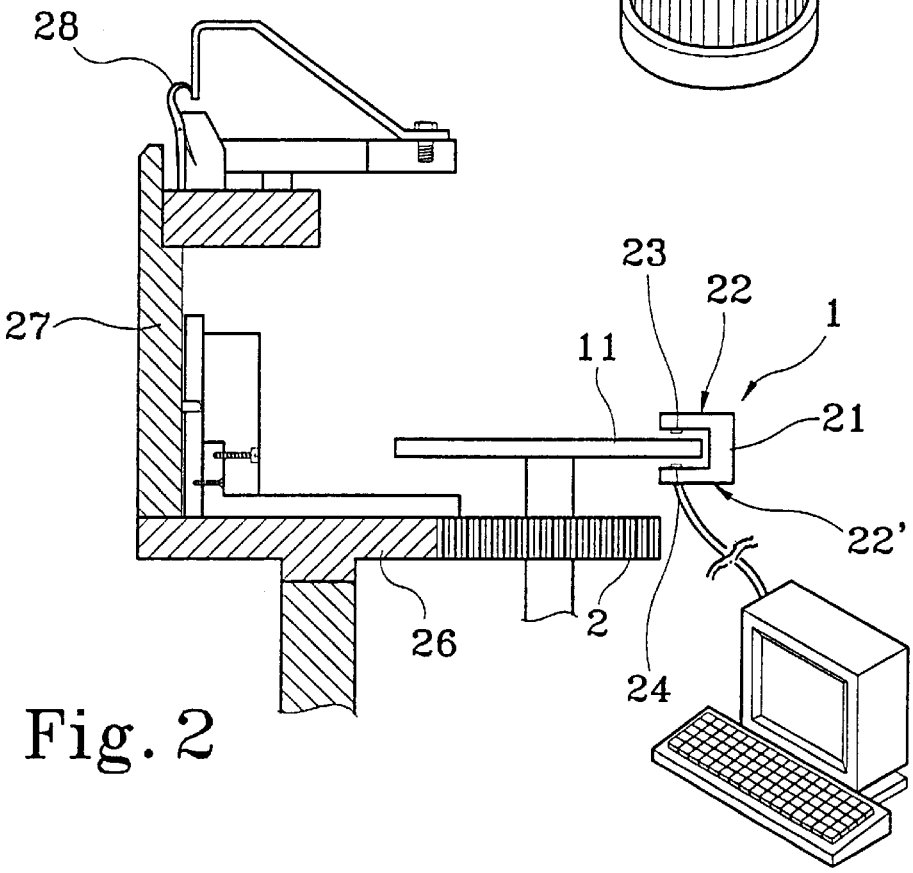
Fig. 2

NEEDLE POSITION DETECTING SYSTEM FOR A CIRCULAR KNITTING MACHINE

BACKGROUND THE INVENTION

The present invention relates to a needle position detecting system for a circular knitting machine, and more particularly to such a needle position detecting system which detects the positions of the needles accurately, so that a computer can control the needles to perform a jacquard knitting.

Various needle selection mechanisms have been disclosed for use in circular knitting machines for controlling needles in performing a jacquard knitting. Exemplars of these mechanisms are seen in U.S. Pat. No. 5,568,738 entitled "NEEDLE SELECTION DEVICE OF A CIRCULAR KNITTING MACHINE"; UK Pat. No. 1,354,980 entitled "IMPROVED NEEDLE SELECTION SYSTEM FOR KNITTING MACHINES". Because the needles of a circular knitting machine are controlled by a computer to perform a jacquard knitting, the computer must know the respective positions of the needles so that the jacquard knitting can be accurately performed. Therefore, a needle position detecting system must be provided. Conventionally, a needle position detecting system generally comprises a plurality of magnetic elements respectively mounted on the periphery of the needle cylinder, and a solenoid switch mounted in a socket corresponding to the magnetic elements. When the magnetic elements are turned with the needle cylinder, the solenoid switch is respectively induced. By counting the number of inductions of the solenoid switch, the respective positions of the needles are measured, and therefore the computer can control the needles to perform a jacquard knitting. However, this needle position detecting system has drawbacks. Because of the limitation of the time interval between each On and Off of the solenoid switch, the density of the magnetic elements is limited to a low level, i.e., one magnetic element is installed at about the distance of 8 needles. Therefore, the computer can only detect the position of every 8 needles. This result greatly affects the accuracy of the control of every individual needle. Further, because every mechanical element has its manufacturing tolerance, a high error is produced when a large number of needles are turned with the needle cylinder. Therefore, the error must be properly corrected during knitting. However, correcting the error is not an easy job.

SUMMARY OF THE INVENTION

The present invention has been accomplished to provide a needle position detecting system which eliminates the aforesaid drawbacks. According to the present invention, an optical encoder is mounted on a drive gear, which is controlled to turn the needle cylinder of the circular knitting machine to detect the turning direction of the needle cylinder and the respective positions of the needles. Because the optical encoder is induced 8 times per every needle distance, the precision of the needle position detecting system is high. Furthermore, because the optical encoder is coaxially mounted on the drive gear, it is not necessary to change the structure of the needle cylinder for the installation of the needle position detecting system.

BRIEF DESCRIPTION OF THE DRAWINGS

FIG. 1A is an elevational view of the present invention, showing the needle position detecting system installed, along with the drive gear meshed with the driven gear of the needle cylinder;

FIG. 1B is an enlarged view of area B in FIG. 1A, showing the relationship between the optical encoder and a wheel;

FIG. 2 is a side view of the present invention;

DETAILED DESCRIPTION OF THE PREFERRED EMBODIMENT

Figure 3:
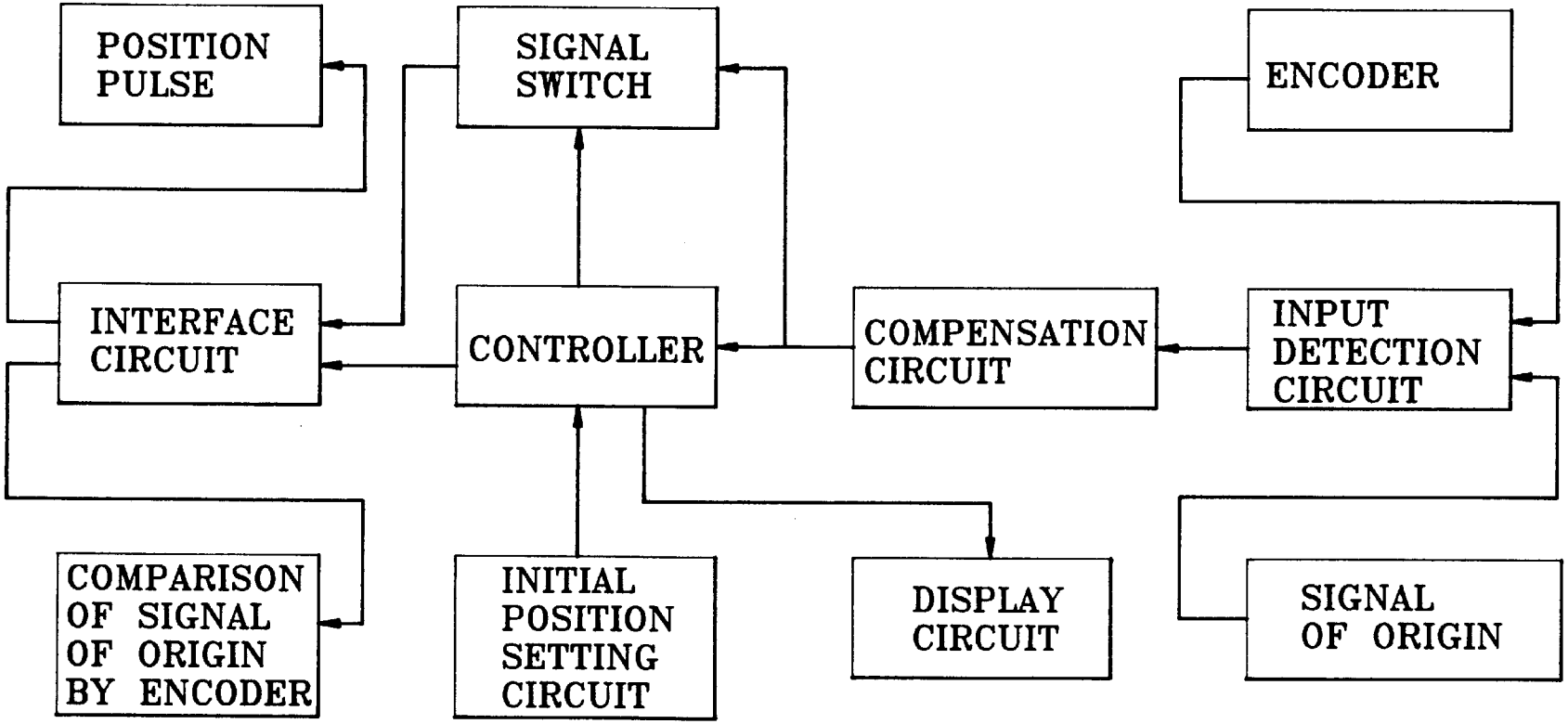
FIG. 3 is a circuit block diagram according to the present invention.
Figure 5:
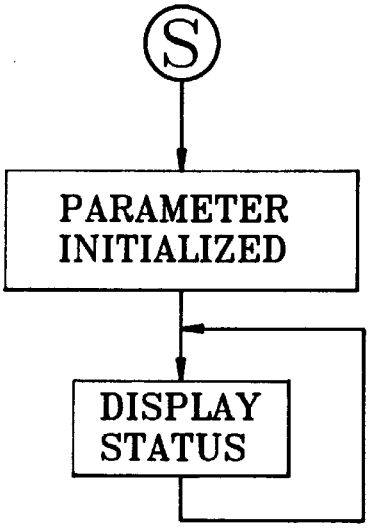
FIG. 5 is a flow chart of the slave control unit according to the present invention.
Figure 4:
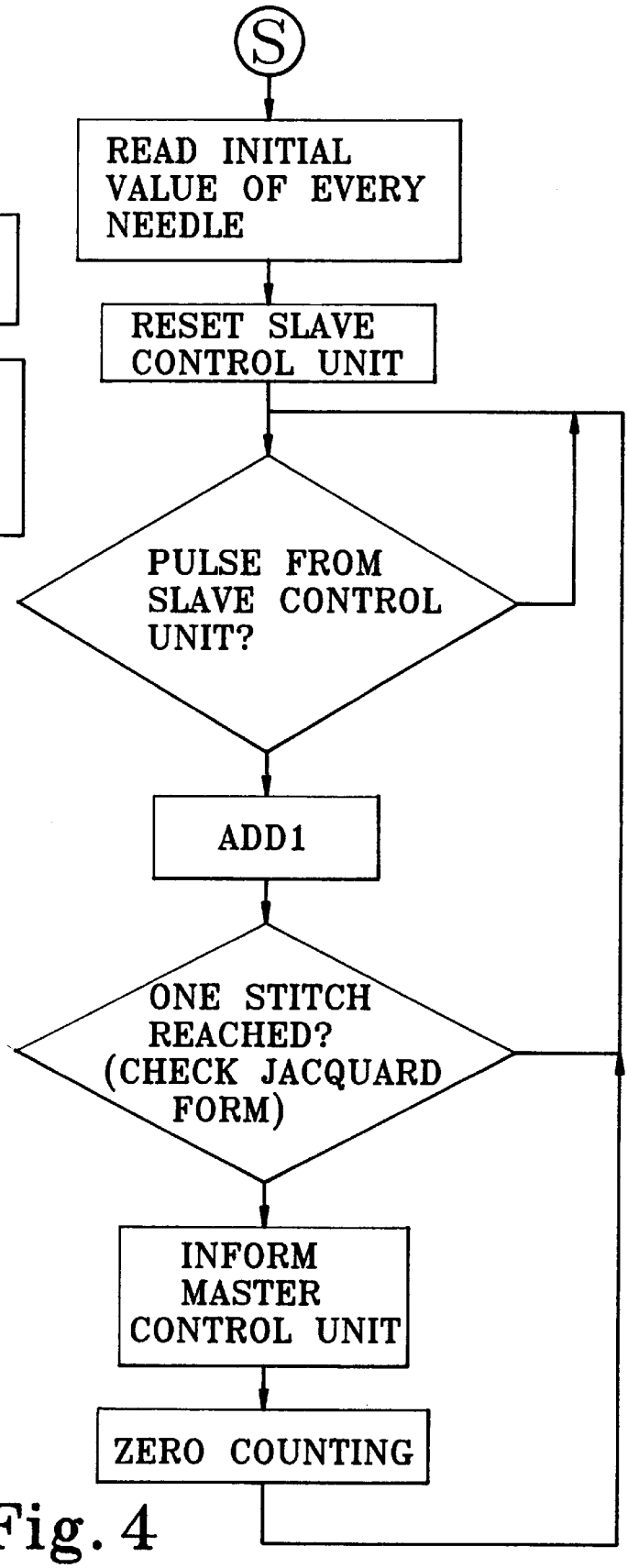
FIG. 4 is a flow chart of the master control unit according to the present invention.
Figure 6:
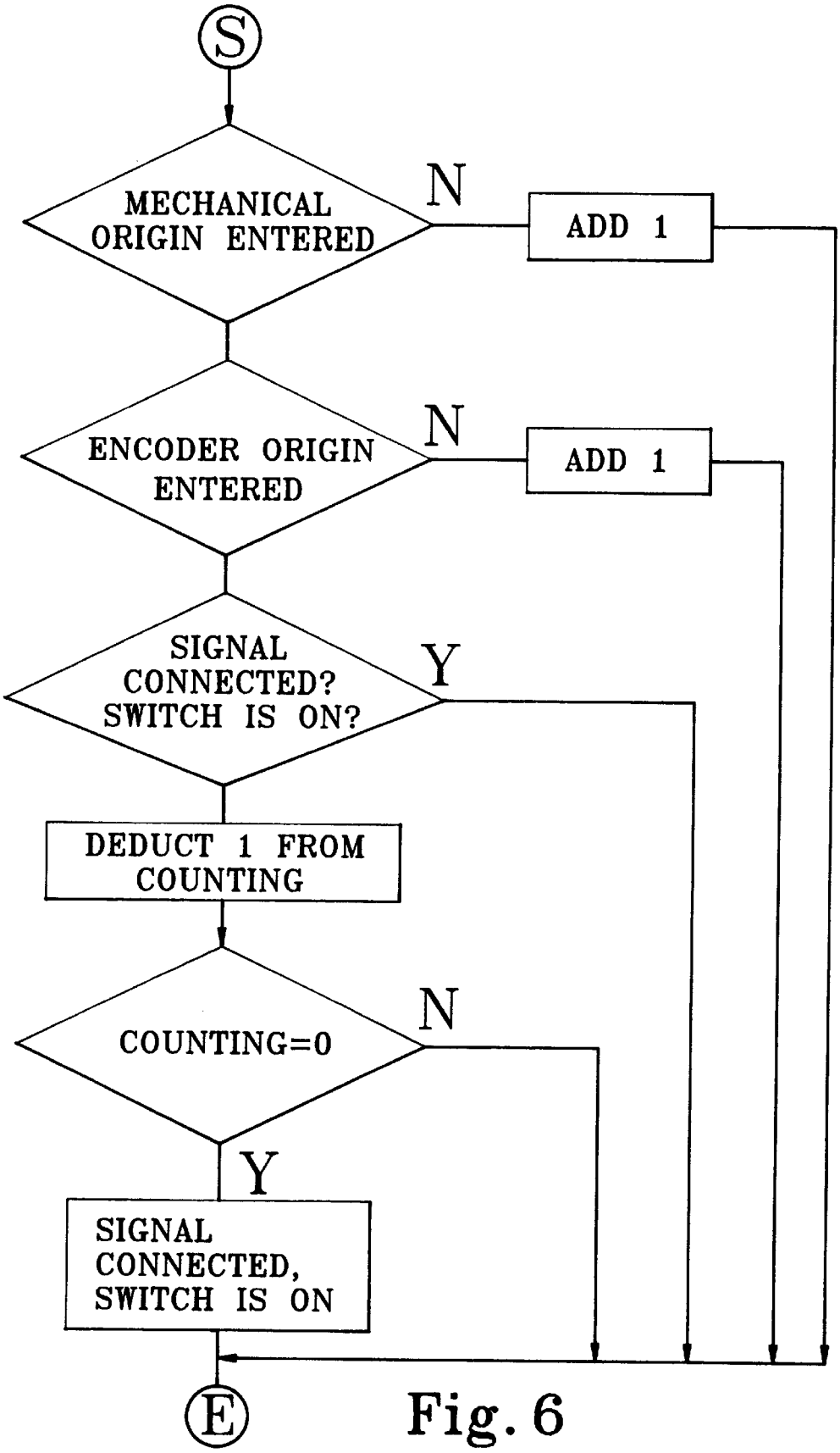
FIG. 6 is a flow chart showing the processing of the interruption of the pulse of the encoder according to the present invention.
Figure 7:
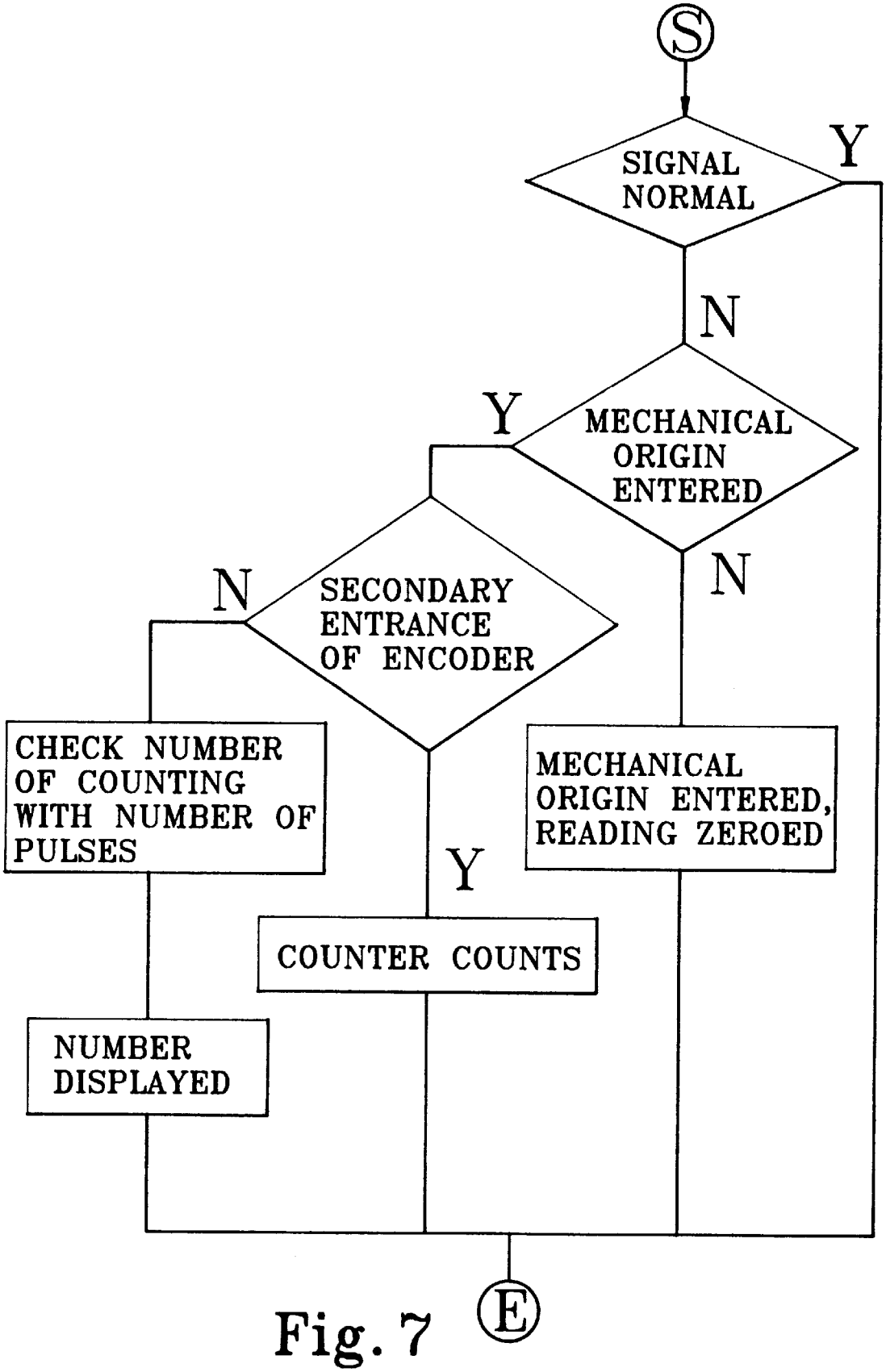
FIG. 7 is a flow chart showing the processing of the interruption of origin of the encoder according to the present invention.

Referring to FIGS. 1A, 1B and 2, the present invention comprises a needle cylinder 27 carrying a plurality of needles 28, a driven gear 26 fixedly mounted on the needle cylinder 27, a drive gear 2 meshed with the driven gear 26, a motor 25 adapted for turning the drive gear 2, a transmission mechanism for example a belt transmission mechanism 250 coupled between the motor 25 and the drive gear 2, and an optical encoder 1. The optical encoder 1 comprises a wheel 11 coaxially connected to the drive gear 2 and turned with it, and a fixed holder frame 21 spaced from the periphery of the wheel 11. The wheel 11 has a plurality of through holes 10;10' spaced around the periphery. The fixed holder frame 21 comprises two wings 22;22' respectively suspending above and below top and bottom sides of the wheel 11, two phototransistors 23 mounted on one wing 22, and two photo couplers 24 mounted on the other wing 22'. The phototransistors 23 are adapted to produce a photo signal. The photo couplers 24 are adapted to receive the photo signal from the phototransistors 23, and then to provide a pulse signal to a computer 30 subject to the nature of the photo signal received. When the needle cylinder 26 is rotated by the drive gear 2, the through holes 10;10' alternatively pass over the optical path between the phototransistors 23 and the photo couplers 24, causing the photo signals from phototransistors 23 to be intermittently masked. Therefore the photo couplers 24 are induced to provide a respective pulse signal to the computer 30 for counting the rotations of the needle cylinder 26 determining the respective positions of the needles 28, so that the computer controls a needle selection system to perform a jacquard knitting. Because two phototransistors 23 and two photo couplers 24 are installed, the turning direction of the needle cylinder 26 can easily be identified by judging the time difference between the pulse signals of the photo couplers 26 to determine the amount of forward or backward rotation from an initial needle position.

Because there is a fixed speed ratio between the drive gear 2 and the driven gear 26, the rotation of the wheel 11 is maintained at a certain ratio relative to the rotation of the needle cylinder 27, i.e., if a particular needle 28 is set as the origin of the mechanism, it will be returned to the origin after the wheel 11 has been turned for a fixed number of turns. Therefore, the computer can precisely count out the location of the origin of the mechanism by counting the number of actuations of the photo couplers 24 during the knitting operation of the circular knitting machine. The speed ratio between the drive gear 2 and the driven gear 26 is set so that the photo couplers 24 are induced eight times when every needle 28 is moved through one unit, i.e., the precision is as high as ⅛ of the distance in which the needle 28 is moved. Therefore adjustment can easily be achieved if the needles 28 are not operated accurately.

Referring to FIG. 3, the output signal of the encoder 1 and the signal of origin of the mechanism are processed through an input detection circuit, compensation circuit, signal switch, a controller and an interface circuit, so that a position pulse is outputted from the interface circuit for comparison with the signal of origin for use in controlling a jacquard knitting. The controller comprises a microprocessor DS80C320, a read write memory 62256, a read only memory 27512, and two I/O interface decoder circuits. The initial position setting circuit provided is comprised of two Dip-Switches and a buffer circuit. Through the initial position setting circuit, the model of the machine can be set, and the position of origin of the mechanism can be adjusted. These data are read through the controller. The display circuit is comprised of a LED and a Latch Buffer, and controlled by the controller to show the operation (normal/abnormal) status of the system. The input detection circuit is comprised of a photo coupling isolating circuit and a filter circuit, and adapted to remove noise from the signals received. The compensation circuit is adapted to obtain signals, and to compensate errors resulted from braking or reverse rotation of the knitting machine. The compensation circuit picks up the rising curve sections or descending curve sections of the output signals A and B of the encoder 1 and their reverse signals AM and BM, so as to provide pulses corresponding to the rising curve sections or descending curves section of the signals received for comparison with the original signals A and B. Therefore the forward or backward rotation of the machine is detected, and the accurate position of each needle is measured by counting the number of pulses. The signal switch is controlled by the controller to access forward rotation pulses and the origin of the encoder, and then to convert received signals into an interrupting signal by which the controller calculates the position of the first needle of the needle cylinder 27 and then turn on the interface circuit. The interface circuit communicates with the controller through two two-way buffers, and is compatible to ISA Bus for IBM PC.

The flow chart of the program of the controller is shown in Figures from 4 to 7. The system adopts a master slave processing method, so as not to waste the operation time of the main control unit. The operation of counting up and counting down during the rotation of the needle cylinder is processed by the salve control unit, and the control of jacquard knitting is controlled by the master control unit.

As indicated, the present invention uses a rotary encoder 1 to detect the position of each needle so that the needles can be accurately controlled to perform a jacquard knitting.

We claim:

1. A needle position detecting system of a circular knitting machine, comprising:

a computer:

a needle cylinder carrying a plurality of needles wherein each needle occupies a respective position on said cylinder;

a driven gear fixedly mounted on said needle cylinder and driven to turn it;

a drive gear meshed with said driven gear and driven to turn it;

a motor drive controlled to turn said drive gear; and an optical encoder connected to said drive gear and adapted to count the number of rotations of said drive gear and said needle cylinder for detecting the respective positions of said needles, wherein said optical encoder comprises a wheel coaxially connected to said gear and turned with it, said wheel having a plurality of through holes spaced around its border, a fixed holder frame spaced from the periphery of said wheel and having a first wing and a second wing respectively suspending above and below top and bottom sides of said wheel, at least one phototransistor mounted on said first wing for producing a photosignal, and at least one photo coupler mounted on said second wing for receiving the photo signal from said at least one phototransistor through the through holes of said wheel, said photo coupler adapted to provide a pulse signal to said computer for calculating said number of needle cylinder rotations and the respective positions of said needles.

2. The needle position detecting system of claim 1, wherein said optical encoder comprises two phototransistors mounted on said first wing of said holder frame for providing a respective photo signal, and two photo couplers mounted on said second wing of said holder frame for receiving the photo signals from said phototransistors and providing a pulse signal to the computer, said computer including means for detecting the time difference between the respective signals whereby the amount of forward or backward rotation from an initial needle position is determined.

* * * * *